US006886196B2

(12) United States Patent
Nygren et al.

(10) Patent No.: US 6,886,196 B2
(45) Date of Patent: May 3, 2005

(54) BED RAIL WITH FOLD CONTROLLER

(75) Inventors: Kurt Nygren, Harvard, MA (US); Jorge Tomas, Wrentham, MA (US); Steve Lepke, Wakefield, MA (US)

(73) Assignee: Cosco Management, Inc., Wilmington, DE (US)

( * ) Notice: Subject to any disclaimer, the term of this patent is extended or adjusted under 35 U.S.C. 154(b) by 77 days.

(21) Appl. No.: 10/734,346

(22) Filed: Dec. 12, 2003

(65) Prior Publication Data

US 2004/0128763 A1 Jul. 8, 2004

Related U.S. Application Data

(60) Provisional application No. 60/433,113, filed on Dec. 13, 2002.

(51) Int. Cl.[7] ..... A47C 21/08
(52) U.S. Cl. ..... 5/430; 5/426
(58) Field of Search ..... 5/430, 429, 428, 5/426, 425, 427

(56) References Cited

U.S. PATENT DOCUMENTS

| | | | | |
|---|---|---|---|---|
| 2,071,155 | A | * 2/1937 | Alexander | 5/658 |
| 3,419,922 | A | 1/1969 | Malherbe | |
| 3,932,903 | A | 1/1976 | Adams et al. | |
| 4,178,645 | A | * 12/1979 | Cosme | 5/426 |
| 4,186,456 | A | 2/1980 | Huempfner | |
| 4,612,679 | A | 9/1986 | Mitchell | |
| 4,641,385 | A | 2/1987 | Peters et al. | |
| 4,747,171 | A | 5/1988 | Einsele et al. | |
| 5,038,430 | A | * 8/1991 | Bly | 5/425 |
| 5,394,580 | A | 3/1995 | Foster et al. | |
| 5,519,905 | A | 5/1996 | Bernstein et al. | |
| 5,522,100 | A | 6/1996 | Schilling et al. | |
| 5,577,277 | A | 11/1996 | Sundberg et al. | |
| 5,784,732 | A | 7/1998 | Vail | |
| 6,021,533 | A | 2/2000 | Ellis et al. | |
| 6,446,283 | B1 | 9/2002 | Heimbrock et al. | |
| 2003/0024047 | A1 | 2/2003 | Wu | |

FOREIGN PATENT DOCUMENTS

| | | | |
|---|---|---|---|
| GB | 636452 | * 5/1950 | 5/426 |

* cited by examiner

*Primary Examiner*—Alexander Grosz
(74) *Attorney, Agent, or Firm*—Barnes & Thornburg LLP

(57) ABSTRACT

A bed rail is disclosed for use with a bed. The bed rail includes a fold controller to control foldable movement of the bed rail.

33 Claims, 7 Drawing Sheets

BED RAIL WITH FOLD CONTROLLER

This application claims priority under 35 U.S.C. § 119(e) to U.S. Provisional Application No. 60/433,113, filed Dec. 13, 2002, which is hereby incorporated by reference herein.

CROSS-REFERENCE

Cross-reference is made to co-pending U.S. patent application Ser. No. 10/735,356 titled "Bed Rail" and U.S. patent application Ser. No. 10/734,392 entitled "Bed Rail With Clamping Force Indicator" each of which is assigned to the same assignee as the present application, is filed concurrently herewith, and is hereby incorporated by reference herein.

BACKGROUND

The present disclosure relates to bed rails. Bed rails are used with beds to help retain individuals in bed.

SUMMARY

According to the present disclosure, a bed rail comprises a side rail and a clamp. The clamp cooperates with the side rail to clamp a mattress to mount the side rail alongside the mattress and to unclamp the mattress. The clamp is configured for foldable movement to move the side rail between a raised position and a fold-down position. The clamp includes a fold controller to control movement between the raised and fold-down positions.

The fold controller includes a leg and a leg receiver. The leg is arranged to be received in the leg receiver to position the side rail in the raised position and to be removed from the leg receiver to position the side rail in the fold-down position. An articulated joint is coupled to the leg and the leg receiver to facilitate movement of the leg relative to the leg receiver between the raised and fold-down positions.

The fold controller includes a lock and a lock release. The lock is used to lock the leg in the leg receiver to position the side rail in the raised position. The lock release is used to release the lock to allow removal of the leg from the leg receiver to position the side rail in the fold-down position.

Additional features of the apparatus will become apparent to those skilled in the art upon consideration of the following detailed description exemplifying the best mode of the disclosure as presently perceived.

BRIEF DESCRIPTION OF THE DRAWINGS

The detailed description particularly refers to the accompanying figures in which.

DETAILED DESCRIPTION

Figures 1, 2:
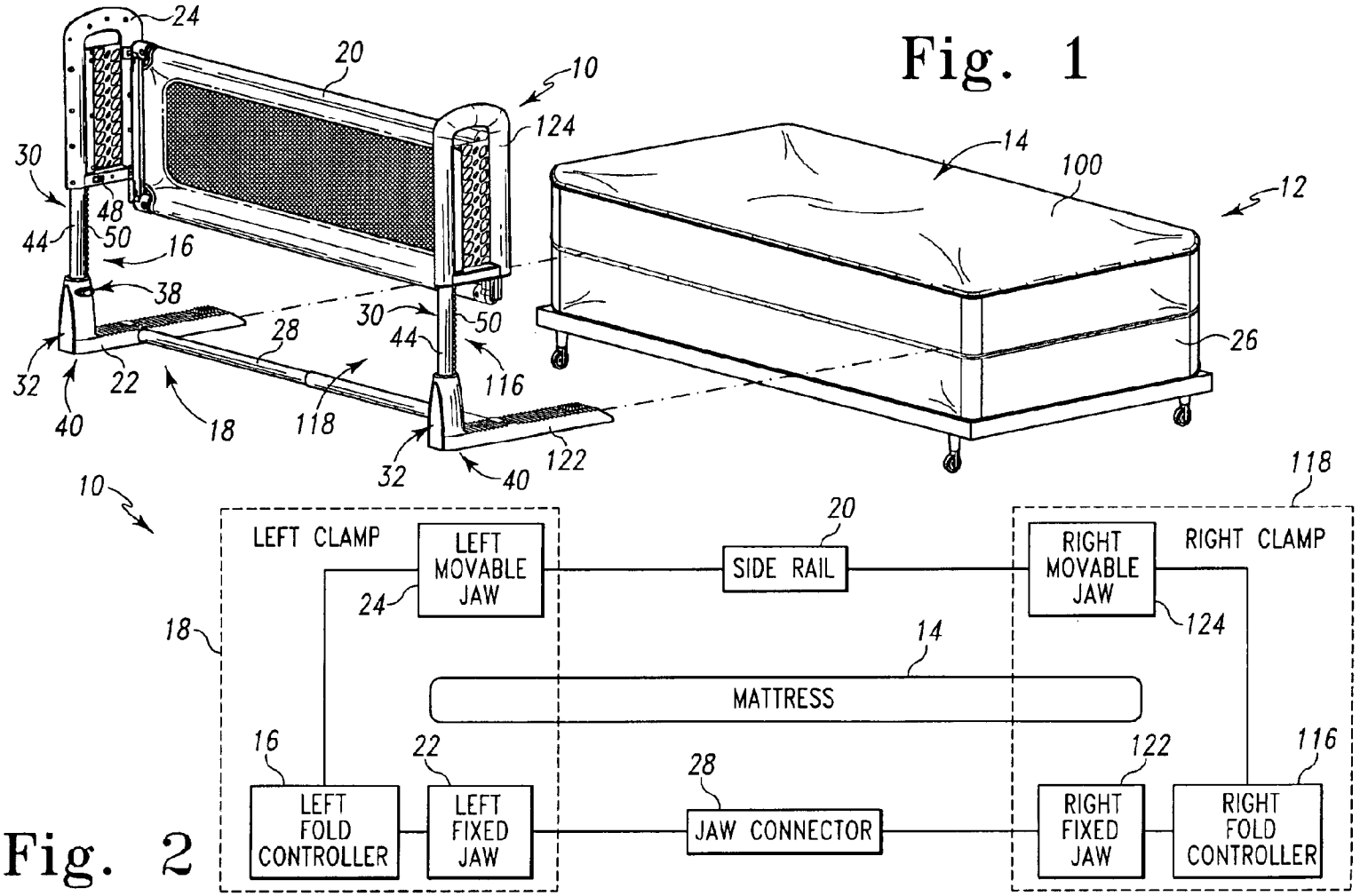
FIG. 1 is a perspective view showing a bed and a bed rail including a side rail extending between left and right clamps arranged to cooperate with the side rail to clamp a mattress of the bed to position the side rail alongside the mattress.
FIG. 2 is a diagrammatic view showing each clamp including a fold controller coupled to a fixed jaw and a movable jaw and arranged to control foldable movement of the bed rail.
Figure 4:
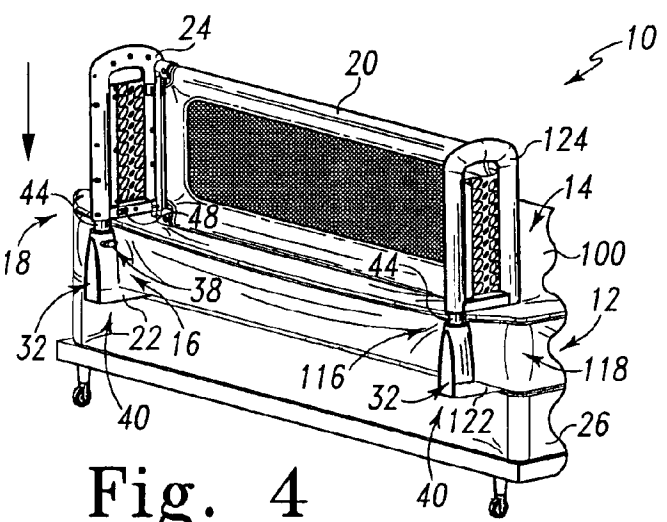
FIG. 4 is a perspective view showing the bed rail in the clamped position in which the bed rail clamps the mattress to mount the side rail alongside the mattress.
Figure 3:
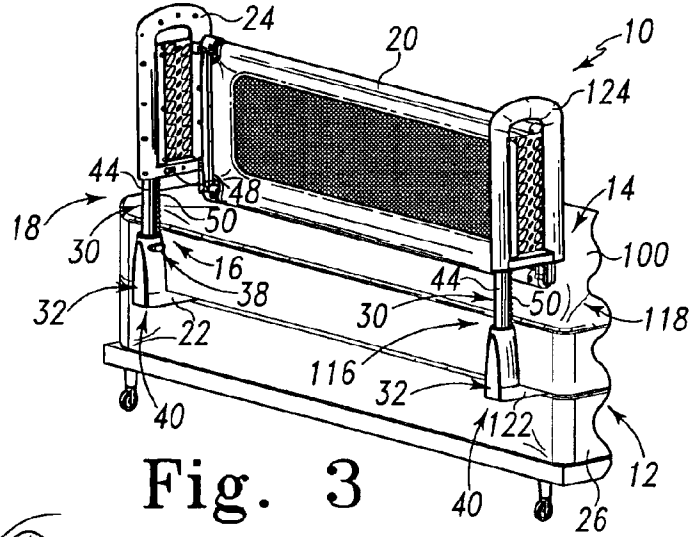
FIG. 3 is a perspective view showing the bed rail in a raised position in which the bed rail is ready to be moved to a clamped position shown, for example, in FIG. 4 or to a fold-down position shown, for example, in FIG. 6.
Figure 8:
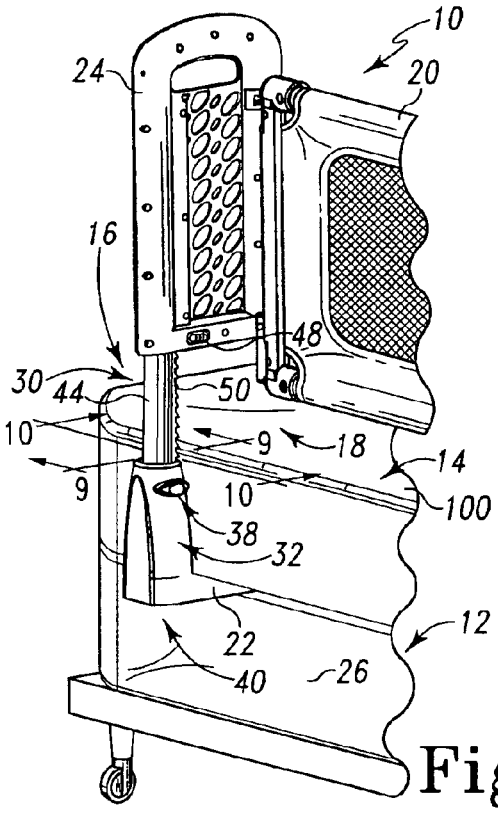
FIG. 8 is a perspective view, with portions broken away, showing the left clamp and a left end portion of the side rail in the raised position.

A bed rail 10 is configured to be mounted to a bed 12, as suggested, for example, in FIG. 1. Bed rail 10 is mounted initially to bed 12 in a raised position in which bed rail 10 does not clamp a mattress 14 included in bed 12, as shown, for example, in FIGS. 3 and 8. From that position, bed rail 10 can be moved to either a clamped position shown, for example, in FIG. 4 or an out-of-the-way, fold-down position shown, for example, in FIGS. 5, 6, 12, and 15. In the raised position, bed rail 10 clamps mattress 14 so that bed rail 10 can be used to inhibit unintended movement of a person (not shown) off bed 12. The fold-down position is useful to allow uninhibited movement of a person off bed 12. Left and right fold controllers 16, 116 are included in bed rail 10 to control foldable movement of bed rail 10 between the raised and fold-down positions.

Bed rail 10 includes left and right clamps 18, 118 and a side rail 20 coupled thereto, as shown, for example, in FIG. 1 and diagrammatically in FIG. 2. Clamps 18, 118 and side rail 20 cooperate to clamp mattress 14 to mount side rail 20 alongside mattress 14.

Left clamp 18 includes a left fixed jaw (or base) 22, a left movable jaw 24, and left fold controller 16, as shown, for example, in FIG. 2. Similarly, right clamp 118 includes a right fixed jaw (or base) 122, a right movable jaw 124, and a right fold controller 116, as shown, for example, in FIG. 2.

Fixed jaws 22, 122 are adapted to be positioned under mattress 14 in a fixed position between mattress 14 and an underlying box spring unit 26, as shown, for example, in FIGS. 3–6. A jaw connector 28 coupled to left and right fixed jaws 22, 122 is used for stabilization of bed rail 10.

Movable jaws 24, 124 are coupled to side rail 20 and are arranged to move relative to fixed jaws 22, 122 to clamp and unclamp mattress 14. Movable jaws 24, 124 are arranged to move toward fixed jaws 22, 122 to move side rail 20 toward mattress 14 to clamp mattress 14 between side rail 20 and fixed jaws 22, 122 to mount side rail 20 alongside mattress 14, as shown, for example, in FIG. 4. Movable jaws 24, 124 are arranged to move away from fixed jaws 22, 122 to move side rail 20 away from mattress to unclamp mattress 14. Further details of the clamping and unclamping operation of bed rail 10 is discussed in U.S. patent application Ser. No. 10/735,356 entitled "Bed Rail" and U.S. patent application Ser. No. 10/734,392 entitled "Bed Rail with Clamping Force Indicator" both filed on Dec. 12, 2003.

Left and right clamps 18, 118 are configured for foldable movement to move side rail 20 between the raised and fold-down positions. In the raised position, side rail 20 is positioned higher than fixed jaws (or bases) 22, 122 so that side rail 20 is positioned higher than a top surface 100 of mattress 14. In the fold-down position, side rail 20 is positioned higher than fixed jaws (or bases) 22, 122 so that side rail 20 is positioned higher than top surface 100 of mattress.

Left and right fold controllers 16, 116 are arranged to control such foldable movement of left and right clamps 18, 118. It is within the scope of this disclosure for fold controllers 16, 116 to control foldable movement of clamps 18, 118 between the clamped position and the fold-down position. As such, the clamped position may also be considered to be a "raised" position.

Left and right clamps 18, 118 are similar to one another in structure and function. Thus, further description herein of left clamp 18 and its components applies also to right clamp 118 and its components.

Figure 7:
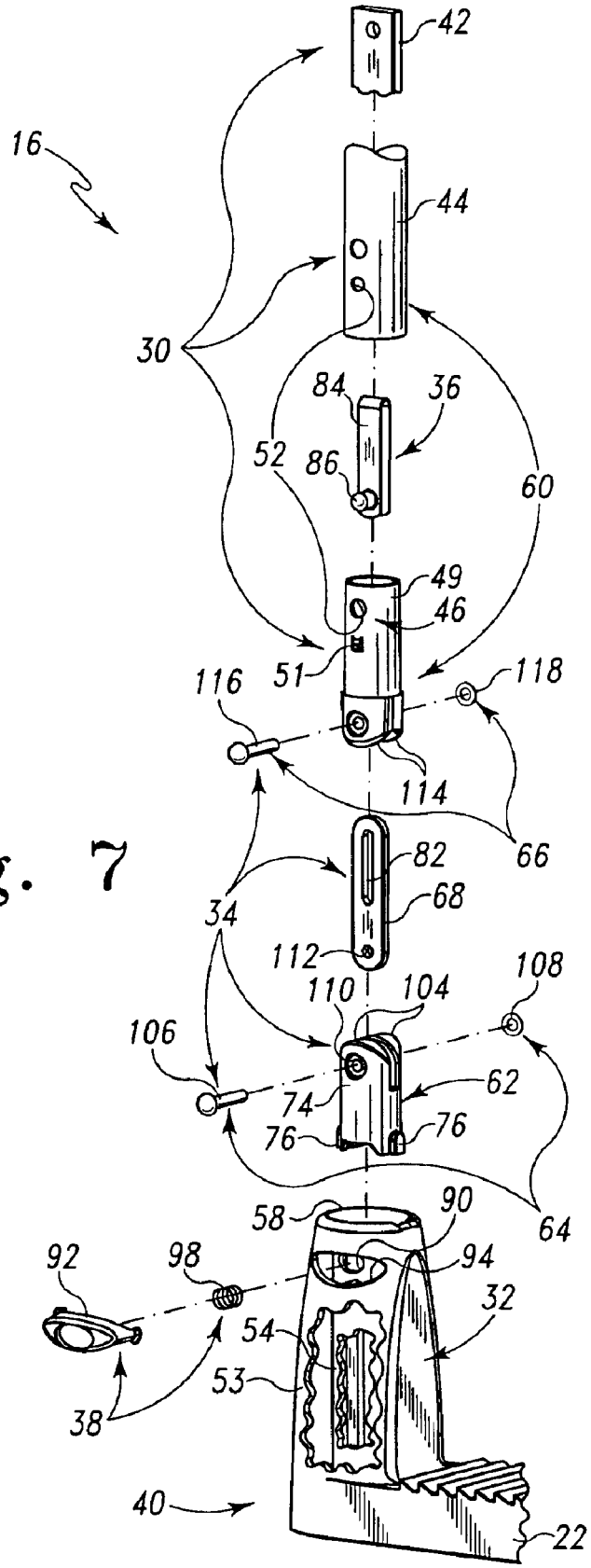
FIG. 7 is an exploded perspective view of components of the fold controller of the left clamp.

Fold controller 16 includes a leg 30, a leg receiver 32, an articulated joint (or articulated "ankle" joint) 34, a releasable lock 36, and a lock release 38, as shown, for example, in FIG. 7. Leg 30 is coupled to movable jaw 24 for movement of side rail 20 coupled thereto between the raised and fold-down positions. Leg 30 is arranged to be received in leg receiver 32 to position side rail 20 in the raised position and is arranged to be removed from leg receiver 32 to position side rail 20 in the fold-down position. Leg receiver 32 is configured, for example, as a socket and cooperates with fixed jaw 22 to provide one of two feet 40 of bed rail 10. Articulated joint 34 is arranged to allow leg 30, and thus side rail 20, to move relative to leg receiver 32 between the raised and fold-down positions. Lock 36 is used to lock leg 30 in leg receiver 32 when leg 30 assumes the raised position. Lock release 38 is used to release lock 36 to allow removal of leg 30 from leg receiver 32 for movement to the fold-down position.

Leg 30 includes telescoping inner and outer tubes 42, 44 and an attachment 46 to outer tube 42, as shown, for example, in FIG. 7. Inner tube 42 is coupled to movable jaw 24 and is arranged to move into and out of outer tube 44 upon movement of movable jaw 24 along outer tube 44 during clamping and unclamping of mattress 14. A spring-biased movable button 48 coupled to movable jaw 24 is arranged to engage a ratchet 50 coupled to outer tube 44 to control movement of movable jaw 24 along outer tube 44. Attachment 46 is coupled to outer tube 42 upon insertion of an attachment body 49 included in attachment 46 into outer tube 42 and engagement between an attachment lug 51 coupled to body 49 and a lug-receiving opening 52 formed in outer tube 42, as shown, for example, in FIG. 9.

Figure 9:
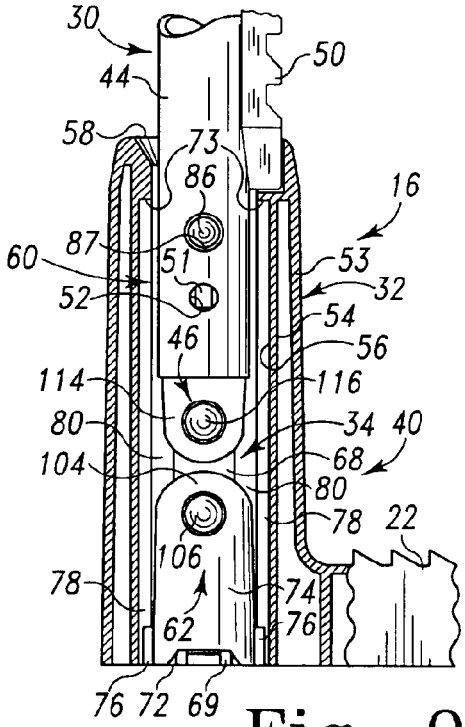
FIG. 9 is a sectional view taken along lines 9—9 of FIG. 8 showing the left fold controller including a leg receiver configured as a socket, a leg extending into the socket, and an articulated joint including a slidable anchor positioned in the leg receiver below the leg and a link coupled to the anchor by a first pivot and to the leg by a second pivot.

Leg receiver 32 includes an outer sleeve 53 and an inner sleeve 54, as shown, for example, in FIG. 9. Outer sleeve 53 is coupled to fixed jaw 22 and surrounds inner sleeve 54. Outer and inner sleeves 53, 54 are coupled to one another at top portions thereof. Inner sleeve 54 is formed to include a channel 56 and an upper end opening 58 through which a lower leg end portion 60 of leg 30 passes as it moves into and out of channel 56. Outer tube 44 and attachment 46 cooperate to provide lower leg end portion 60.

Articulated joint 34 is coupled to leg 30 and leg receiver 32 for movement of leg 30 relative to leg receiver 32 between the raised and fold-down positions. Joint 34 includes an anchor 62, first and second pivots 64, 66, and a link 68 coupled to anchor 62 by first pivot 64 and to attachment 46 by second pivot 66.

Figure 10:
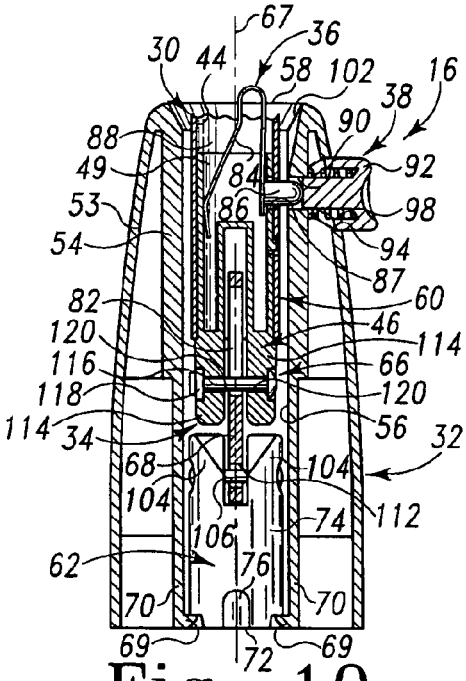
FIG. 10 is a sectional view taken along lines 10—10 of FIG. 8 showing the left fold controller including a lock positioned in a locked position to lock the leg in the leg receiver.
Figure 11:
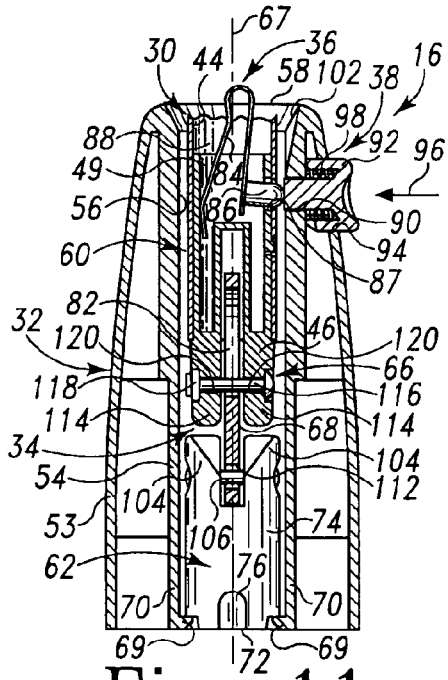
FIG. 11 is a sectional view similar to FIG. 10 showing actuation of a lock release to move the lock to an unlocked position to allow removal of the leg from the leg receiver and movement of the bed rail to the fold-down position.
Figure 12:
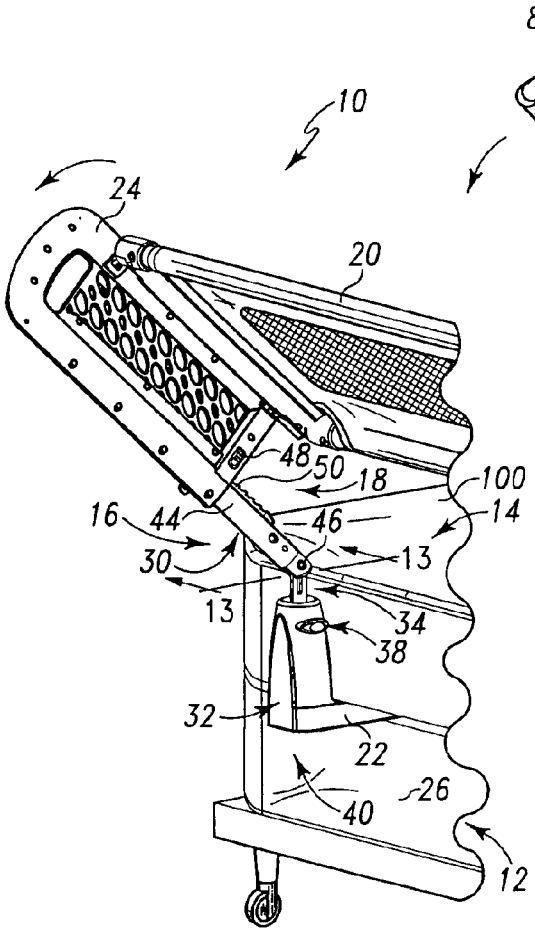
FIG. 12 is a perspective view, with portions broken away, showing foldable movement of the left clamp and the left end portion of the side rail.

Anchor 62 includes an anchor body 74 and a pair of anchor ears 104 coupled to and extending upwardly from anchor body 74, as shown, for example, in FIGS. 7, 10, and 11. First pivot 64 includes a first pivot axle 106 and a first washer 108. First pivot axle 106 extends through an anchor ear opening 110 formed in each anchor ear 104, through first washer 108, and through a link opening 112 formed in link 68 for pivotable movement between anchor 62 and link 68 upon movement of leg 30 between the raised and fold-down positions.

Attachment 46 includes a pair of attachment ears 114 coupled to and extending from attachment body 49, as shown, for example, in FIGS. 7, 10, and 11. Second pivot 66 includes a second pivot axle 116 and a second washer 118. Second pivot axle 116 extends through an attachment ear opening 120 formed in each attachment ear 114, through second washer 118, and through an elongated slot 82 formed in link 68.

Figure 13:
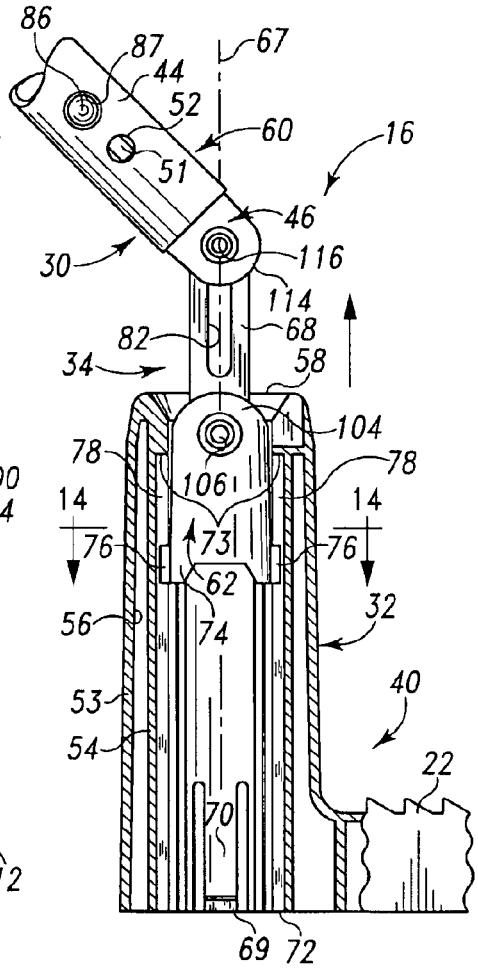
FIG. 13 is a sectional view taken along lines 13—13 of FIG. 12 showing slidable movement of the anchor in a channel formed in the leg receiver upon movement of the bed rail to the fold-down position.
Figure 16:
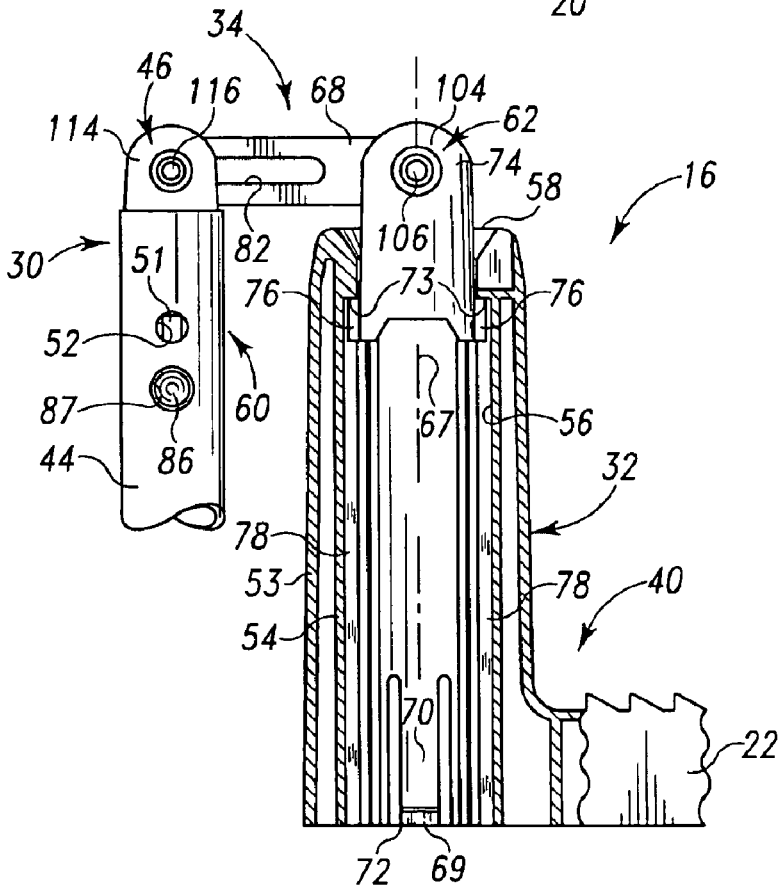
FIG. 16 is a sectional view taken along lines 16—16 of FIG. 15 showing engagement between the anchor and an anchor stop included in the leg receiver when the bed rail assumes the fold-down position.

Anchor 62 is used to anchor leg 30, movable jaw 24, and side rail 20 to foot 40 when bed rail 10 assumes the fold-down position. To do so, anchor 62 is positioned in channel 56 to slide in channel 56 longitudinally along an axis 67 of channel 56, as shown, for example, in FIG. 13. Anchor 62 is arranged slide in channel 56 between a lower, at-rest position shown, for example, in FIGS. 9–11 and an upper, anchoring position shown, for example, in FIG. 16. In the lower, at-rest position, anchor 62 is held in channel 56 by finger lugs 69 of a pair of flexible fingers 70 included in inner sleeve 54. Fingers 70 are flexible to allow insertion of anchor 62 into channel 56 through a lower end opening 72 during assembly of bed rail 10. In the upper, anchoring position, anchor 62 engages an anchor stop 73 included in inner sleeve 54. Such engagement between anchor 62 and anchor stop 73 maintains the connection between leg 30 and leg receiver 32 when leg 30 assumes the fold-down position.

Figure 14:
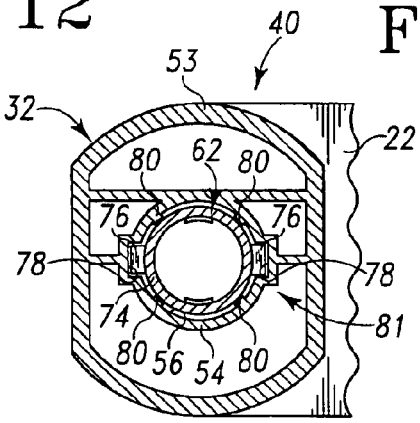
FIG. 14 is a sectional view taken along lines 14—14 of FIG. 13 showing tabs of the anchor extending into grooves of the channel and rails of the channel spaced circumferentially about a body of the anchor for slidable engagement therewith.

Anchor 62 and channel 56 are arranged to facilitate movement of anchor 62 therein. Anchor 62 includes a pair of tabs 76 coupled to and extending outwardly from anchor body 74, as shown, for example, in FIGS. 7, 9, 13, 14, and 16. Tabs 76 fit in a pair of grooves 78 formed in channel 56 for movement in grooves between the lower, at-rest position and the upper, anchoring position, as shown, for example, in FIG. 14. Tabs 76 engage anchor stop 73 when anchor 62 assumes the upper, anchoring position. Channel 56 includes four circumferentially spaced-apart rails 80 that extend longitudinally along channel 56, as shown, for example, in FIG. 14. Rails 80 are arranged to engage body 74 as anchor 62 moves through channel 56. Grooves 78 and rails 80 cooperate to provide an anchor guide 81 for guiding movement of anchor 62 in channel 56.

Second pivot axle 116 is arranged to move in elongated slot 82 upon movement of leg 30 between the raised and fold-down positions, as suggested, for example, in FIGS. 10, 11, 12, 13, 15, and 16. Such movement of second pivot axle 116 in slot 82 allows for movement of leg 30 toward anchor 62 upon movement of leg 30 to the raised position to promote efficient use of space in channel 56. Such movement of second pivot axle 116 in slot 82 also allows for movement of leg 30 away from anchor 62 upon movement of leg 30 to the fold-down position so that leg 30 and side rail 20 can move from being right-side up in the raised position to being upside-down in the fold-down position.

Lock 36 is arranged to move between a locking position shown, for example, in FIG. 10 and an unlocking position shown, for example, in FIG. 11. In the locking position, lock 36 locks leg 30 in leg receiver 32 to thus lock leg 30 and side rail 20 in the raised position. In the unlocking position, lock 36 is positioned to allow removal of leg 30 from leg receiver 32 to allow movement of leg 30 and side rail to the fold-down position. Lock release 38 is arranged to move lock 36 from the locking position to the unlocking position, as shown, for example, in FIG. 11.

Lock 36 includes a spring 84 and a locking pin 86 coupled thereto, as shown, for example, in FIG. 7. Spring 84 is mounted in an interior region 88 formed in leg 30 and provided by outer tube 44 and attachment 46. Locking pin 86 is aligned with a leg opening 87 formed in leg 30 for movement therein upon movement between the locking and unlocking positions. In the locking position, pin 86 is arranged to extend into an inner sleeve opening 90 formed in inner sleeve 54 to lock leg 30 in leg receiver 32 and thus lock leg 30 and side rail 20 in the raised position, as shown, for example, in FIG. 10.

A button 92 included in lock release 38 is arranged to move inwardly through an outer sleeve opening 94 to retract pin 86 inwardly from inner sleeve opening 90 into interior region 88 to the unlocking position upon application of a release force 96 to button 92, as shown, for example, in FIG. 11. A spring 98 positioned between inner sleeve 54 and button 92 is used to move button 92 outwardly upon removal of release force 96 from button 92.

To use bed rail 10, fixed jaw 22 is positioned between mattress 14 and box spring unit 26 in a fixed position. Initially, bed rail 10 is in the raised position, as shown, for example, in FIGS. 3 and 8–10. In this position, lower leg end portion 60 is locked in channel 56 by lock 36 so that leg 30 and side rail 10 are rightside-up and side rail 20 is positioned higher than a top surface 100 of mattress 14. Side rail 20 is higher than top surface 100 to inhibit unintended movement of a person off mattress 14 once mattress is clamped. Lower leg end portion 60 remains locked in channel 56 upon clamping and unclamping of mattress 14. Button 92 is actuated to release locking pin 86 from inner sleeve opening 90 to unlock leg 30, as shown, for example, in FIG. 11.

Once unlocked, leg 30 and side rail 20 can transition from the raised position to the fold-down position, as shown, for example, in FIGS. 5 and 12–14. During such transitional movement, leg 30 is withdrawn from channel 56 thereby causing second pivot 66 to move through slot 82 and engage link 68. Engagement between second pivot 66 and link 68 causes anchor 62 to start moving upwardly through channel 56 from its lower, at-rest position toward its upper, anchoring position, as shown, for example, in FIG. 13. Anchor guide 81 guides movement of anchor 62 as anchor 62 moves through channel 56, as shown, for example, in FIG. 14.

Figure 6:
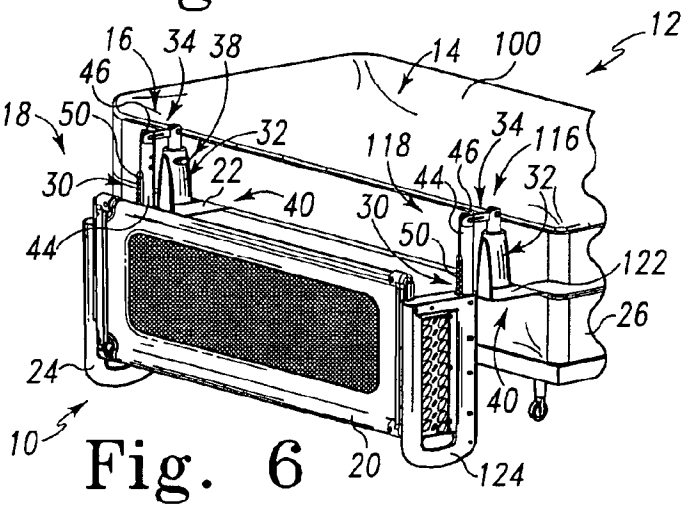
FIG. 6 is a perspective view showing the bed rail assuming the fold-down position.
Figure 5:
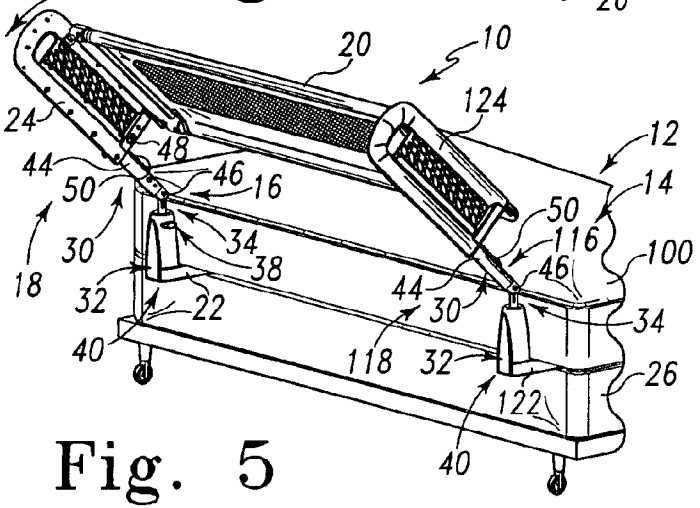
FIG. 5 is a perspective view showing foldable movement of the bed rail toward the fold-down position.
Figure 15:
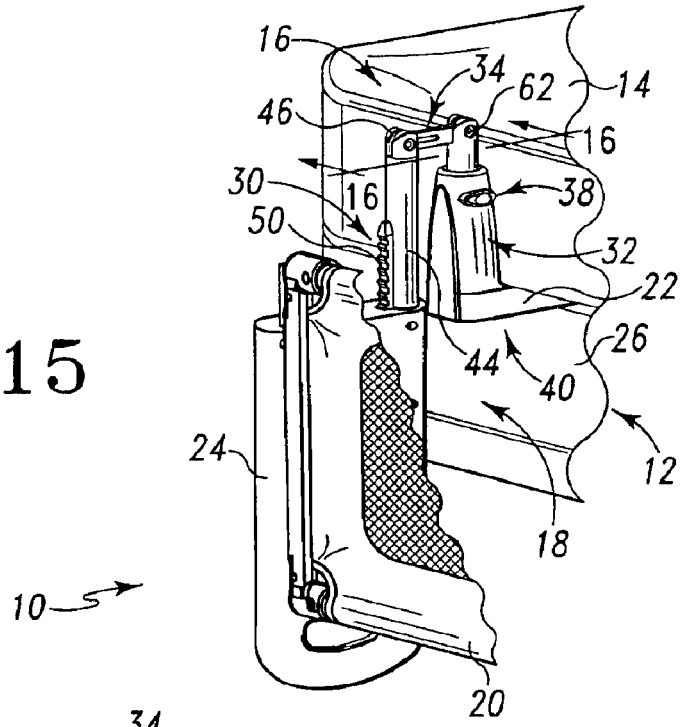
FIG. 15 is a perspective view, with portions broken away, showing the left clamp and the left end portion of the side rail in the fold-down position.

In the fold-down position, leg 30 and side rail 20 are upside-down and side rail 20 is lower than top surface 100 of mattress 14, as shown, for example, in FIGS. 6 and 15. Leg 30 and side rail 20 are oriented in this manner to minimize the amount of space occupied by bed rail 10 when bed rail 10 is not in use. Tabs 76 of anchor 62 engage anchor stop 73 to maintain the connection between leg 30 and leg receiver 32 when leg 30 and side rail 20 assume the fold-down position.

Figure 18:
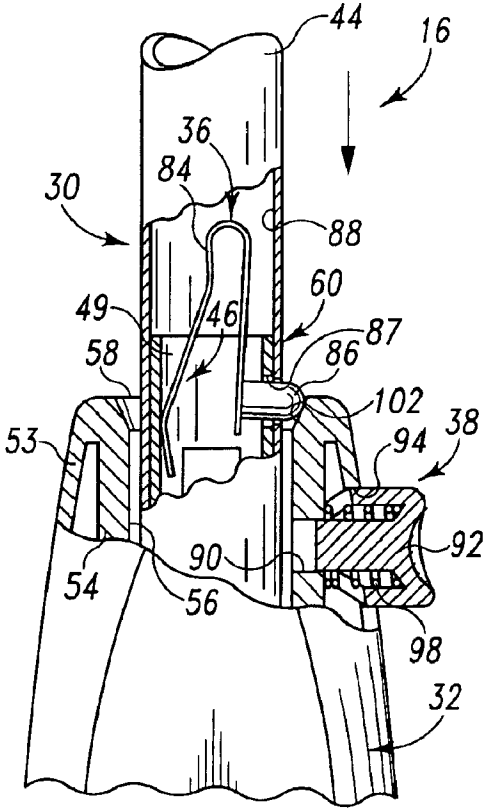
FIGS. 17–19 are sectional views that are similar to FIGS. 10 and 11 and show, in series, movement of the lock to its locked position upon insertion of the leg into the channel of the leg receiver during movement of the bed rail to the raised position.
Figure 17:
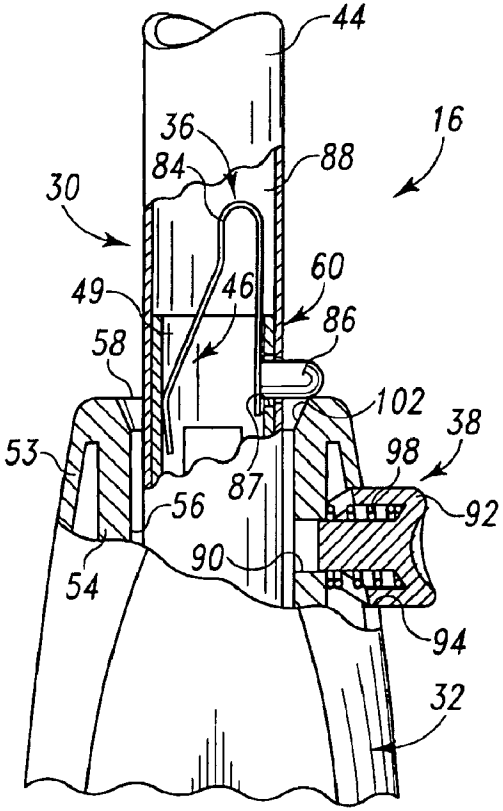
Figure 19:
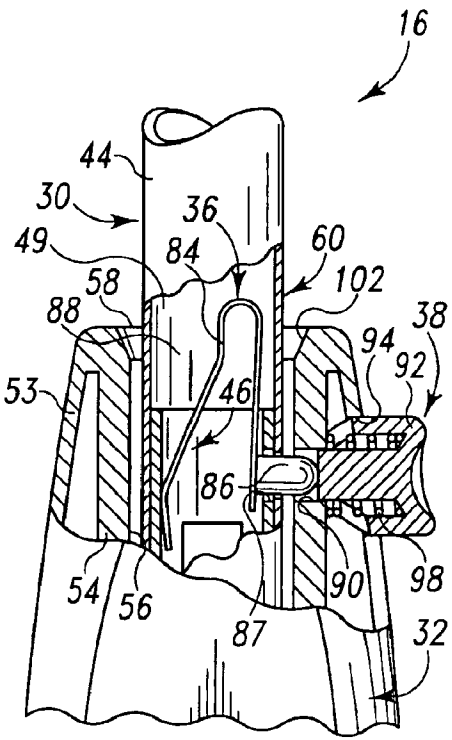

Leg 30 and side rail 20 can be moved back to the raised position by inserting lower leg end portion 60 back into channel 56. As such movement occurs, locking pin 86 engages an inclined surface 102 formed in inner sleeve 54 and is retracted into interior region 88 of leg 30 in response to such engagement, as shown, for example, in FIGS. 17 and 18. Locking pin 86 becomes aligned with and is moved into inner sleeve opening 90 by spring 84 to lock leg 30 in leg receiver 32 upon further insertion of lower leg end portion 60 into channel 56, as shown, for example, in FIG. 19. The leg 30 and side rail 20 thus re-assume the raised position upon reception of leg 30 in leg receiver 32.

Fold controller 16 provides means for controlling movement of side rail 20 relative to a base 22 between a raised position extending higher than base 22 so that side rail 20 extends higher than top surface 100 of mattress 14 when base 22 is positioned under mattress 14 in the fixed position and a fold-down position extending lower than base 22 so that side rail 20 extends lower than top surface 100 of mattress 14 when base 22 is positioned under mattress 14 in the fixed position. Fold controller 116 provides means for controlling movement of side rail 20 relative to a base 122 between a raised position extending higher than base 122 so that side rail 20 extends higher than top surface 100 of mattress 14 when base 122 is positioned under mattress 14 in the fixed position and a fold-down position extending lower than base 122 so that side rail 20 extends lower than top surface 100 of mattress 14 when base 122 is positioned under mattress 14 in the fixed position. It is within the scope of this disclosure for mattress 14 to be unclamped in such a raised position. It is also within the scope of this disclosure for mattress 14 to be clamped in such a raised position.

What is claimed is:

1. A bed rail comprising a side rail and a clamp arranged to cooperate with the side rail to clamp a mattress to mount the side rail alongside the mattress and to unclamp the mattress, the clamp including a base adapted to extend under the mattress in a fixed position and means for controlling movement of the side rail relative to the base between a raised position extending higher than the base so that the side rail extends higher than a top surface of the mattress when the base is positioned under the mattress in the fixed position and a fold-down position extending lower than the base so that the side rail extends lower than the top surface of the mattress when the base is positioned under the mattress in the fixed position.

2. The bed rail of claim 1, wherein the movement-controlling means includes a leg receiver coupled to the base, a leg coupled to the side rail and arranged to be received in the leg receiver upon movement of the leg to the raised position and to be removed from the leg receiver upon movement of the leg to the fold-down position, and an articulated joint coupled to the leg and the leg receiver to facilitate movement of the leg between the raised and fold-down positions.

3. The bed rail of claim 1, wherein the leg receiver is formed to include a channel that receives the leg upon movement of the leg to the raised position, the articulated joint includes an anchor, first and second pivots, and a link coupled to the anchor by the first pivot and to the leg by the second pivot, the anchor is arranged to slide in the channel upon movement of the leg between the raised and fold-down positions and is arranged to engage an anchor stop included in the leg receiver when the leg assumes the fold-down position, and the link is formed to include an elongated slot through which the second pivot extends for movement therein to allow movement of the leg toward and away from the anchor upon movement of the leg between the raised and fold-down positions.

4. The bed rail of claim 2, wherein the articulated ankle joint includes an anchor, first and second pivot axles, and a link coupled to the anchor by the first pivot axle and to the leg by the second pivot axle and the anchor is positioned in a channel formed in the leg receiver to slide in the channel upon movement of the leg between the raised position in which the leg is positioned in the channel and the fold-down position in which the leg is positioned outside of the channel.

5. The bed rail of claim 4, wherein the anchor includes an anchor body and a pair of anchor ears extending from the anchor body and the first pivot axle extends through an anchor ear opening formed in each anchor ear and through a link opening formed in the link to allow the link to pivot relative to the anchor upon movement of the leg between the raised and fold-down positions.

6. The bed rail of claim 5, wherein the channel includes a pair of grooves and the anchor includes a pair of tabs coupled to the anchor body and extending into the grooves to slide therein upon movement of the leg between the raised and fold-down positions.

7. The bed rail of claim 4, wherein the leg includes a tube and an attachment, the attachment includes an attachment body positioned inside and coupled to the tube and a pair of attachment ears extending from the attachment body and positioned outside of the tube, and the second pivot axle extends through an attachment ear opening formed in each attachment ear and through an elongated slot formed in the link.

8. The bed rail of claim 4, wherein the anchor includes an anchor body and a pair of anchor ears extending from the anchor body, the first pivot axle extends through an anchor ear opening formed in each anchor ear and through a link opening formed in the link, the leg includes a tube and an attachment, the attachment includes an attachment body positioned inside and coupled to the tube and a pair of attachment ears extending from the attachment body and positioned outside of the tube, and the second pivot axle extends through an attachment ear opening formed in each attachment ear and through an elongated slot formed in the link.

9. The bed rail of claim 1, wherein the movement-controlling means includes a lock and a lock release, the lock is arranged to move between a locked position to lock the side rail in the raised position and an unlocked position to allow movement of the side rail to the fold-down position, and the lock release is arranged to move the lock from the locked position to the unlocked position.

10. A bed rail comprising a side rail and a clamp including a fixed jaw adapted to be positioned under a mattress in a fixed position, a movable jaw coupled to the side rail and arranged to move toward the fixed jaw to cause clamping of the mattress to mount the side rail alongside the mattress and to move away from the fixed jaw to cause unclamping of the mattress, and a fold controller coupled to the fixed jaw and the movable jaw and arranged to control movement of the movable jaw relative to the fixed jaw to move the side rail relative to the fixed jaw between a raised position in which the side rail extends higher than the fixed jaw and a fold-down position in which the side rail extends lower than the fixed jaw.

11. The bed rail of claim 10, wherein the fold controller includes a leg coupled to the movable jaw and a leg receiver coupled to the fixed jaw and the leg is arranged to be received in the leg receiver upon movement of the leg to the raised position and is arranged to be removed from the leg receiver upon movement of the leg to the fold-down position.

12. The bed rail of claim 11, wherein the fold controller includes an articulated joint coupled to the leg and the leg receiver to facilitate movement of the leg between the raised and fold-down positions.

13. The bed rail of claim 12, wherein the leg receiver is formed to include a channel arranged to receive the leg upon movement of the leg from the fold-down position to the raised position and the articulated joint includes an anchor that is coupled to the leg and arranged to slide in the channel upon movement of the leg between the raised and fold-down positions and to engage an anchor stop included in the leg receiver when the leg assumes the fold-down position.

14. The bed rail of claim 13, wherein the anchor includes a body and a tab extending outwardly from the body, the tab is arranged to slide in a groove formed in the channel and is arranged to engage the anchor stop, and the body is arranged to slide against a rail included in the channel.

15. The bed rail of claim 13, wherein the articulated joint includes first and second pivots and a link coupled to the anchor by the first pivot and to the leg by the second pivot and the link is formed to include an elongated slot through which the second pivot extends for movement therein to allow movement of the leg toward and away from the anchor upon movement of the leg between the raised and fold-down positions.

16. The bed rail of claim 15, wherein the anchor includes an anchor body and a pair of anchor ears extending from the anchor body, the first pivot includes a first pivot axle extending through an anchor ear opening formed in each anchor ear and through a link opening formed in the link, the leg includes a tube and an attachment, the attachment includes an attachment body positioned inside the tube and a pair of attachment ears extending from the attachment body and positioned outside of the tube, and the second pivot includes a second pivot axle extending through an attachment ear opening formed in each attachment ear and through the elongated slot.

17. The bed rail of claim 11, wherein the leg receiver includes an outer sleeve coupled to the fixed jaw and an inner sleeve coupled to and surrounded by the outer sleeve and the inner sleeve is formed to include a channel arranged to receive the leg upon insertion of the leg through an end opening formed in the inner sleeve.

18. The bed rail of claim 17, wherein the fold controller includes a lock including a locking pin and a spring positioned in an interior region formed in the leg and arranged to move the locking pin through a leg opening formed in the leg into an inner sleeve opening formed in the inner sleeve to lock the leg in the channel when the leg assumes the raised position.

19. The bed rail of claim 18, wherein the inner sleeve includes an inclined surface that is adjacent to the end opening and is arranged to retract the locking pin into the interior region upon movement of the leg into the channel.

20. The bed rail of claim 18, wherein the fold controller includes a lock release including a button extending through an outer sleeve opening formed in the outer sleeve for inward movement against the locking pin to retract the locking pin from the inner sleeve opening into the interior region to allow removal of the leg from the channel upon application of a release force to the button and the lock release includes a spring arranged to move the button outwardly upon removal of the release force from the button.

21. The bed rail of claim 10, wherein the fold controller includes a lock arranged to move between a locked position to lock the side rail in the raised position and an unlocked position to allow movement of the side rail to the fold-down position.

22. The bed rail of claim 21, wherein the fold controller includes a lock release arranged to move the lock from the locked position to the unlocked position.

23. A bed rail comprising a side rail, a leg coupled to the side rail to support the side rail, a foot adapted to extend under a mattress in a fixed position, the foot including a socket, and an articulated ankle joint coupled to the leg and the foot for movement of the leg relative to the foot to move the side rail relative to the foot between raised and fold-down positions when the foot extends under the mattress in the fixed position, wherein the leg is arranged to be inserted into the socket to position the side rail in the raised position and to be removed from the socket to position the side rail in the fold-down position.

24. The bed rail of claim 23, wherein the socket is formed to include a channel arranged to receive the leg and the articulated ankle joint includes an anchor that is coupled to the leg and arranged to slide in the channel between a lower position when the leg is positioned inside the channel in the raised position and an upper position in which the anchor engages an anchor stop included in the socket when the leg is positioned outside the channel in the fold-down position.

25. The bed rail of claim 24, wherein the articulated ankle joint includes first and second pivot axles and a link coupled to the anchor by the first pivot axle and to the leg by the second pivot axle and the link is formed to include an elongated slot through which the second pivot axle extends for movement therein to allow movement of the leg toward the anchor during movement toward the raised position and to allow movement of the leg away from the anchor during movement toward the fold-down position.

26. The bed rail of claim 24, wherein the socket includes flexible fingers arranged to move away from one another to receive the anchor into the channel and to hold the anchor in the channel when the anchor assumes the lower position.

27. The bed rail of claim 23, wherein the socket is formed to include a channel and the articulated ankle joint includes an anchor, first and second pivot axles, and a link coupled to the anchor by the first pivot axle and to the leg by the second pivot axle, and the anchor is positioned in the channel to slide therein upon movement of the leg between the raised and fold-down positions.

28. The bed rail of claim 27, wherein the anchor includes an anchor body and a pair of anchor ears extending from the anchor body and the first pivot axle extends through an anchor ear opening formed in each anchor ear and through a link opening formed in the link to allow the link to pivot relative to the anchor upon movement of the leg between the raised and fold-down positions.

29. The bed rail of claim 27, wherein the leg includes a tube and an attachment, the attachment includes an attachment body positioned inside and coupled to the tube and a pair of attachment ears extending from the attachment body and positioned outside of the tube, and the second pivot axle extends through an attachment ear opening formed in each attachment ear and through an elongated slot formed in the link.

30. The bed rail of claim 23, further comprising a lock and a lock release, the lock is coupled to the leg and arranged to assume a locked position to lock the leg in the socket, and the lock release is coupled to the socket and arranged to move the lock to an unlocked position to allow removal of the leg from the socket.

31. A bed rail comprising a side rail and a clamp coupled to the side rail and adapted to cause clamping of a mattress to mount the side rail alongside the mattress and to cause unclamping of the mattress, the clamp including a base adapted to extend under the mattress in a fixed position, the clamp being configured for foldable movement to move the side rail relative to the base between raised and fold-down positions when the base is positioned under the mattress in the fixed position.

32. The bed rail of claim 31, wherein the clamp includes a leg receiver, a leg arranged to be received in the leg receiver upon movement of the leg and the side rail to the raised position and to be removed from the leg receiver upon movement of the leg and the side rail to the fold-down position, and an articulated joint coupled to the leg receiver and the leg to allow the leg and the side rail to flip over upon movement of the leg and the side rail between the raised and fold-down positions.

33. The bed rail of claim 31, wherein the clamp includes a releasable lock arranged to lock the leg in the raised position.

* * * * *

UNITED STATES PATENT AND TRADEMARK OFFICE

CERTIFICATE OF CORRECTION

PATENT NO. : 6,886,196 B2
DATED : May 3, 2005
INVENTOR(S) : Kurt Nygren et al.

It is certified that error appears in the above-identified patent and that said Letters Patent is hereby corrected as shown below:

Column 7,
Line 10, "The bed rail of claim 1" should be -- The bed rail of claim 2 --.

Signed and Sealed this

Thirteenth Day of September, 2005

JON W. DUDAS
*Director of the United States Patent and Trademark Office*